US011781746B2

(12) United States Patent
Zhang et al.

(10) Patent No.: US 11,781,746 B2
(45) Date of Patent: Oct. 10, 2023

(54) FAN LIGHT

(71) Applicant: FOSHAN CARRO ELECTRICAL CO., LTD., Foshan (CN)

(72) Inventors: Jian-Sheng Zhang, Foshan (CN); Jian Gao, Foshan (CN); Han-Hua Huang, Foshan (CN)

(73) Assignee: Foshan Carro Electrical Co., Ltd., Foshan (CN)

( * ) Notice: Subject to any disclaimer, the term of this patent is extended or adjusted under 35 U.S.C. 154(b) by 0 days.

(21) Appl. No.: 17/654,643

(22) Filed: Mar. 14, 2022

(65) Prior Publication Data

US 2023/0077609 A1 Mar. 16, 2023

(51) Int. Cl.

| | |
|---|---|
| ***F21V 33/00*** | (2006.01) |
| ***F04D 29/34*** | (2006.01) |
| ***F04D 29/52*** | (2006.01) |
| ***F04D 19/00*** | (2006.01) |

(52) U.S. Cl.

CPC ..... *F21V 33/0096* (2013.01); *F04D 19/002* (2013.01); *F04D 29/34* (2013.01); *F04D 29/522* (2013.01)

(58) Field of Classification Search

None

See application file for complete search history.

(56) References Cited

U.S. PATENT DOCUMENTS

| | | | | |
|---|---|---|---|---|
| 6,438,322 | B1 * | 8/2002 | Reiker | F24H 3/0411 392/364 |
| 7,066,721 | B2 * | 6/2006 | Bird | F04D 25/0613 417/423.1 |
| 10,823,375 | B2 * | 11/2020 | Zhang | F21V 17/164 |
| 11,183,903 | B2 * | 11/2021 | Allen | H02K 7/083 |
| 11,296,561 | B2 * | 4/2022 | Zhang | F04D 25/06 |
| 2004/0253112 | A1 * | 12/2004 | Bird | H02K 9/06 416/210 R |
| 2020/0173446 | A1 * | 6/2020 | Horng | F21V 21/096 |
| 2020/0208809 | A1 * | 7/2020 | Zhang | F21S 8/063 |
| 2020/0382038 | A1 * | 12/2020 | Jeung | H02K 11/225 |

OTHER PUBLICATIONS

Hong et al—CN-110350723-A and machine translation (Year: 2019).*

* cited by examiner

*Primary Examiner* — Juan G Flores

(74) *Attorney, Agent, or Firm* — Rosenberg, Klein & Lee

(57) ABSTRACT

A fan light has a fan assembly, a connecting assembly, and a lighting disc assembly. The fan assembly has a motor case, a main shaft, and multiple fan blades. The connecting assembly has a connecting unit main body having a main shaft connecting screw hole and multiple lighting disc fixing holes, a screw fixing hole formed on an inner surface of the main shaft connecting screw hole, and a fixing unit. The main shaft is mounted in the main shaft connecting screw hole. The fixing unit is mounted in the screw fixing hole to fix the main shaft. The lighting disc assembly has a lighting disc fixing shell having multiple lighting disc mounting holes. The lighting disc fixing shell is fixed on the top surface of the connecting unit main body via the lighting disc mounting holes and the lighting disc fixing holes.

18 Claims, 11 Drawing Sheets

FAN LIGHT

BACKGROUND OF THE INVENTION

1. Field of the Invention

The present invention relates to a lighting device, especially to a fan light.

2. Description of the Prior Arts

Being a common household appliance, a fan light is a combination of a fan and a lamp and has both the functions of the lamp and the fan.

A fan assembly and a lighting disc assembly of the conventional fan light are connected by a connecting unit, so the light disc assembly will not rotate along with the fan blade. However, after a long time of use, the fan assembly, the connecting unit, and the lighting disc assembly will be loosened, which may lead to accidents.

To overcome the shortcomings, the present invention provides a fan light to mitigate or obviate the aforementioned problems.

SUMMARY OF THE INVENTION

The main objective of the present invention is to provide a fan light that solves the loosening issue of the fan assembly, the connecting unit, and the lighting disc assembly to prevent accidents.

The fan light has a fan assembly, a connecting assembly, and a lighting disc assembly. The fan assembly has a motor case, a main shaft, and multiple fan blades. The main shaft is mounted through the motor case. The fan blades are mounted on the motor case. The motor case drives the fan blades to rotate around the main shaft. The connecting assembly has a connecting unit main body and a main shaft connecting screw hole. The main shaft connecting screw hole is formed through the connecting unit main body. The main shaft is mounted in the main shaft connecting screw hole. The main shaft connecting screw hole has a first center axis. The screw fixing hole is formed on an inner surface of the main shaft connecting screw hole and is formed through a bottom surface of the connecting unit main body. The screw fixing hole has a second center axis being parallel to the first center axis of the main shaft connecting screw hole. The fixing unit is mounted in the screw fixing hole to fix the main shaft and the main shaft connecting screw hole. The at least one lighting disc hole group is formed on a top surface of the connecting unit main body. Each of the at least one lighting disc hole group has multiple lighting disc fixing holes. The lighting disc assembly has a lighting disc fixing shell and a lighting disc mounting hole. The lighting disc mounting hole is formed on the lighting disc fixing shell. A distance between the lighting disc mounting hole and the first center axis of the main shaft connecting screw hole is shorter than a radius of the connecting unit main body. The lighting disc fixing shell is fixed on the top surface of the connecting unit main body via the lighting disc mounting hole and the lighting disc fixing holes.

The present invention has the following advantages:

1. In the fan light, after the main shaft is mounted in the main shaft connecting screw hole, the main shaft is further fixed with the connecting assembly by a screw mounted in the screw fixing hole from a bottom surface of the connecting unit main body, so that the connecting assembly will not be loosed and detached from the main shaft, thereby preventing accidents.

2. Since the lighting disc fixing shell of the lighting disc assembly is fixed to a top surface of the connecting unit main body, even if the lighting disc fixing shell is loosened from the connecting unit main body, the lighting disc fixing shell can still be hung on the connecting unit main body without falling off, thereby preventing accidents.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
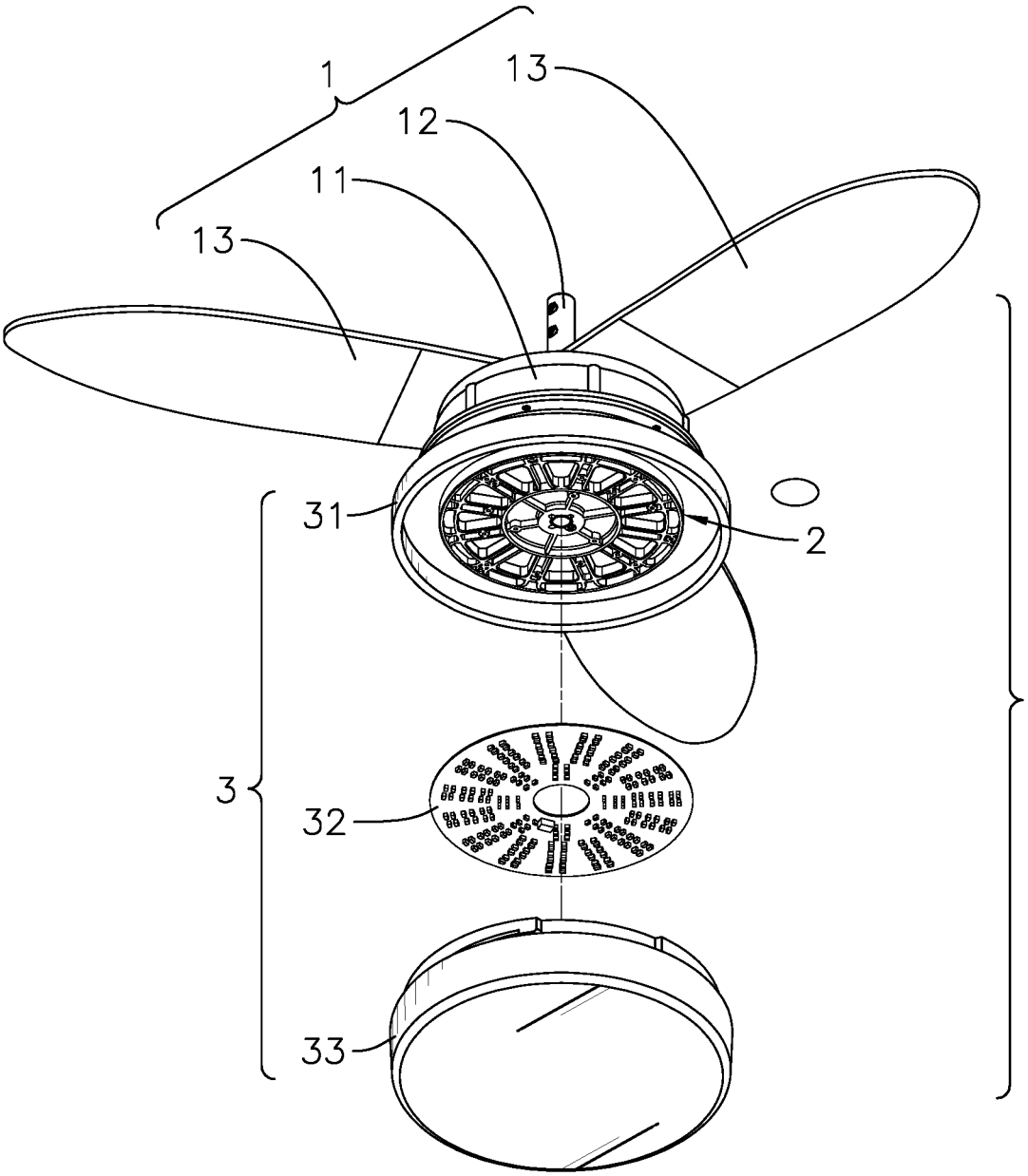
FIG. 1 is an exploded view of a first embodiment of a fan light in accordance with the present invention.
Figure 2:
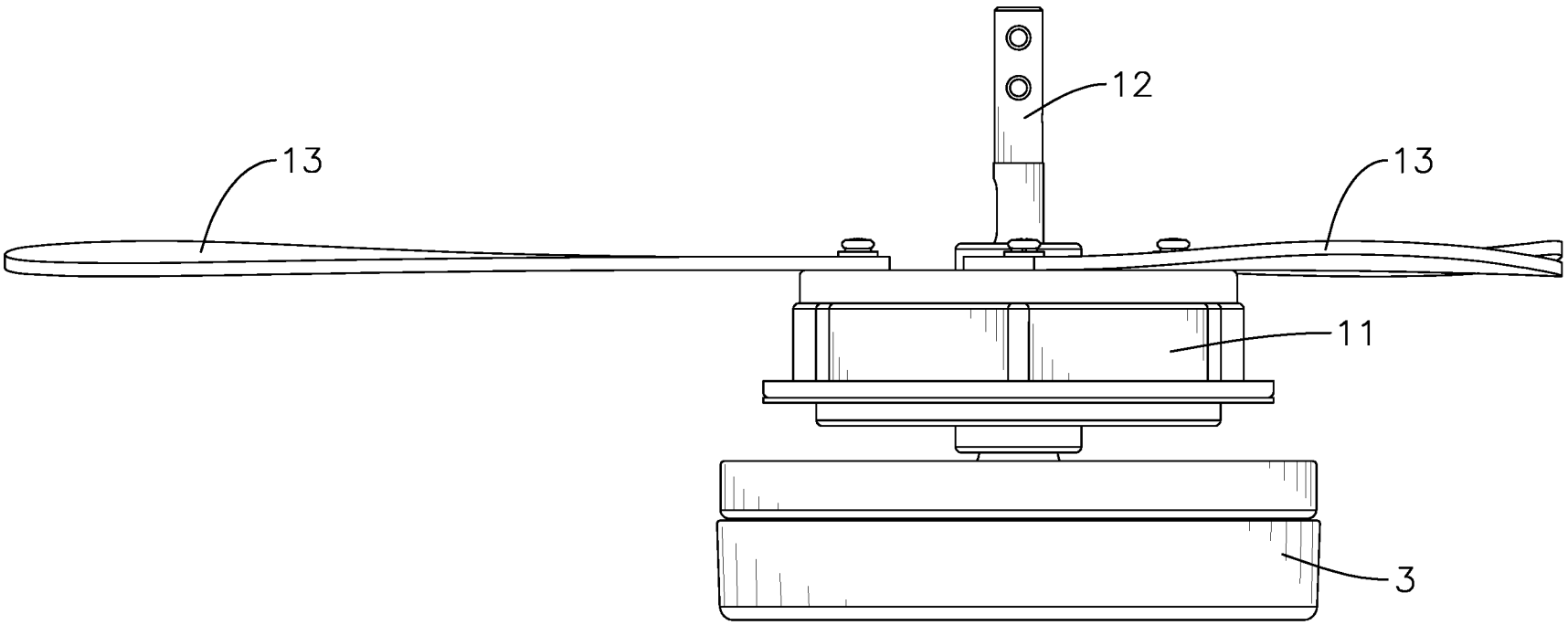
FIG. 2 is a side view of the first embodiment of the fan light in FIG. 1.

With reference to FIGS. 1 to 11, a fan light in accordance with the present invention comprises an assembly 1, a connecting assembly 2, and a lighting disc assembly 3.

The fan assembly 1 has a motor case 11, a main shaft 12, and multiple fan blades 13. The main shaft 12 is mounted through the motor case 11. The fan blades 13 are mounted on the motor case 11. The motor case 11 drives the fan blades 13 to rotate around the main shaft 12.

Figure 6:
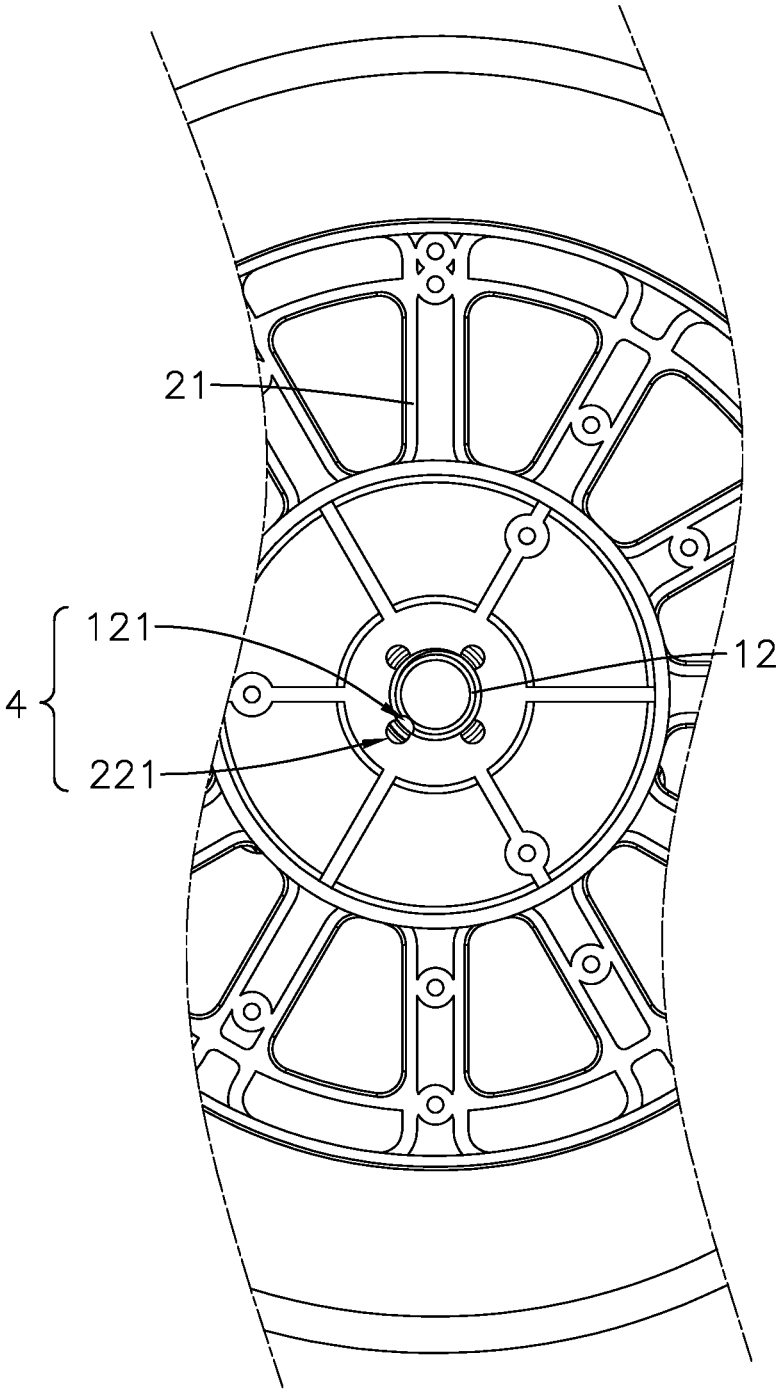
FIG. 6 is a partial enlarged view of the first embodiment of the fan light in FIG. 1, showing the connecting assembly.

The connecting assembly 2 has a connecting unit main body 21 and a main shaft connecting screw hole 22. The connecting unit main body 21 has a main shaft connecting screw hole 22 formed therethrough. The main shaft 12 is mounted in the main shaft connecting screw hole 22. A screw fixing hole 221 is formed on an inner surface of the main shaft connecting screw hole 22 and is formed through a bottom surface of the connecting unit main body 21. A fixing unit (such as a screw) is mounted in the screw fixing hole 221 to fix the main shaft 12 and the main shaft connecting screw hole 22. A first center axis 223 of the main shaft connecting screw hole 22 is parallel to a second axis of the screw fixing hole 221. With reference to FIG. 6, when assembling, an operator mounts the main shaft 12 in the main shaft connecting screw hole 22 first, and then mounts the fixing unit in the screw fixing hole 221. The fixing unit tightens the connecting unit main body 21 and the main shaft 12 to prevent the main shaft 12 from loosening from the main shaft connecting screw hole 22, thereby preventing the connecting unit main body 21 from detaching.

Since the first center axis 223 of the main shaft connecting screw hole 22 is parallel to the second center axis of the screw fixing hole 221, a direction of a force applied by the fixing unit in the screw fixing hole 221 is the same as a direction of a force between the main shaft 12 and the main shaft connecting screw hole 22, thereby further tightening the structure. Specifically, the inner surface of the main shaft connecting screw hole 22 forms a plurality of the screw fixing holes 221, and the screw fixing holes 221 are arranged along a circumference of the inner surface of the main shaft connecting screw hole 22 and are spaced apart from each other. With the screw fixing holes 221, adjusting the relative position of the main shaft 12 and the main shaft connecting screw hole 22 during assembling is easier, and aligning the screw fixing holes 221 and the fixing grooves 121 is also easier. For example, if the inner surface of the main shaft connecting screw hole 22 forms four screw fixing holes 221, for adjusting the position, the screw fixing holes 221 can be aligned with the fixing grooves 121 by rotating the light disc by 90 degrees at most.

A top surface of the connecting unit main body 21 forms at least one lighting disc hole group 211. Each of the at least one lighting disc hole group 211 has multiple lighting disc fixing holes 2111. The lighting disc assembly 3 has a lighting disc fixing shell 31. The lighting disc fixing shell 31 forms multiple lighting disc mounting holes 34. A distance between each of the lighting disc mounting holes 34 and the first center axis 223 of the main shaft connecting screw hole 22 is shorter than a radius of the connecting unit main body 21. The lighting disc fixing shell 31 is fixed on the top surface of the connecting unit main body 21 via the lighting disc mounting holes 34 and the lighting disc fixing holes 2111, and in detail, the lighting disc fixing shell 31 is fixed on the top surface of the connecting unit main body 21 by fixing units such us screws or bolts mounted in the lighting disc mounting holes 34 and the lighting disc fixing holes 2111. Specifically, with reference to FIGS. 3 and 5, for assembling, the lighting disc mounting holes 34 are aligned to the lighting disc fixing holes 2111, and screws are mounted in the lighting disc mounting holes 34 and the lighting disc fixing holes 2111 and are tightened to fix the lighting disc fixing shell 31 on the top surface of the connecting unit main body 21. Since the distance between each of the lighting disc mounting holes 34 and the first center axis 223 of the main shaft connecting screw hole 22 is shorter than a radius of the connecting unit main body 21, even if the fixing units mounted in the lighting disc mounting holes 34 and the lighting disc fixing holes 2111 are loosened, the lighting disc fixing shell 31 can still be hung on the top surface of the connecting unit main body 21 instead of falling off. Specifically, the lighting disc assembly 3 has a lighting unit main body 32 and a light cover 33. After the lighting disc fixing shell 31 is fixed on the top surface of the connecting unit main body 21, the lighting unit main body 32 is mounted in the light cover 33 and then the light cover 33 is buckled with the lighting disc fixing shell 31.

In the fan light, by the main shaft 12 of the motor mounted in the main shaft connecting screw hole 22 and then the screw mounted in the screw fixing hole 221 from the bottom surface of the connecting unit main body 21, the main shaft 12 of the motor is fixed more tightly on the connecting assembly 2 to make the connecting assembly 2 hard to detach from the main shaft 12, thereby preventing accidents. Since the lighting disc fixing shell 31 of the lighting disc assembly 3 is fixed on the top surface of the connecting unit main body 21, even if the fixing units mounted in the lighting disc mounting holes 34 and the lighting disc fixing holes 2111 are loosened, the lighting disc fixing shell 31 can still be hung on the top surface of the connecting unit main body 21 instead of falling off, thereby preventing accidents.

Figure 3:
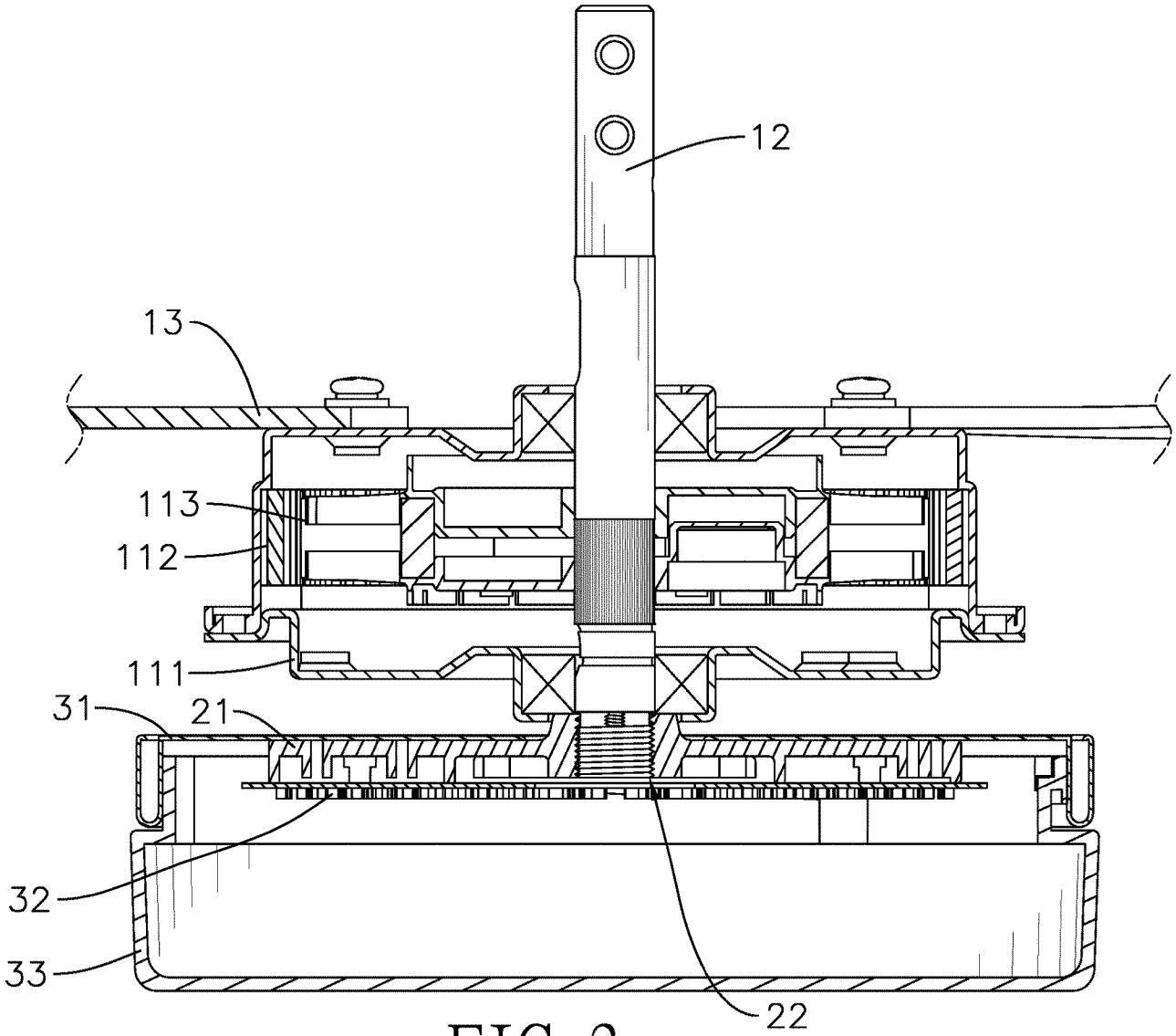
FIG. 3 is a side view in cross section of the first embodiment of the fan light in FIG. 1.
Figure 7:
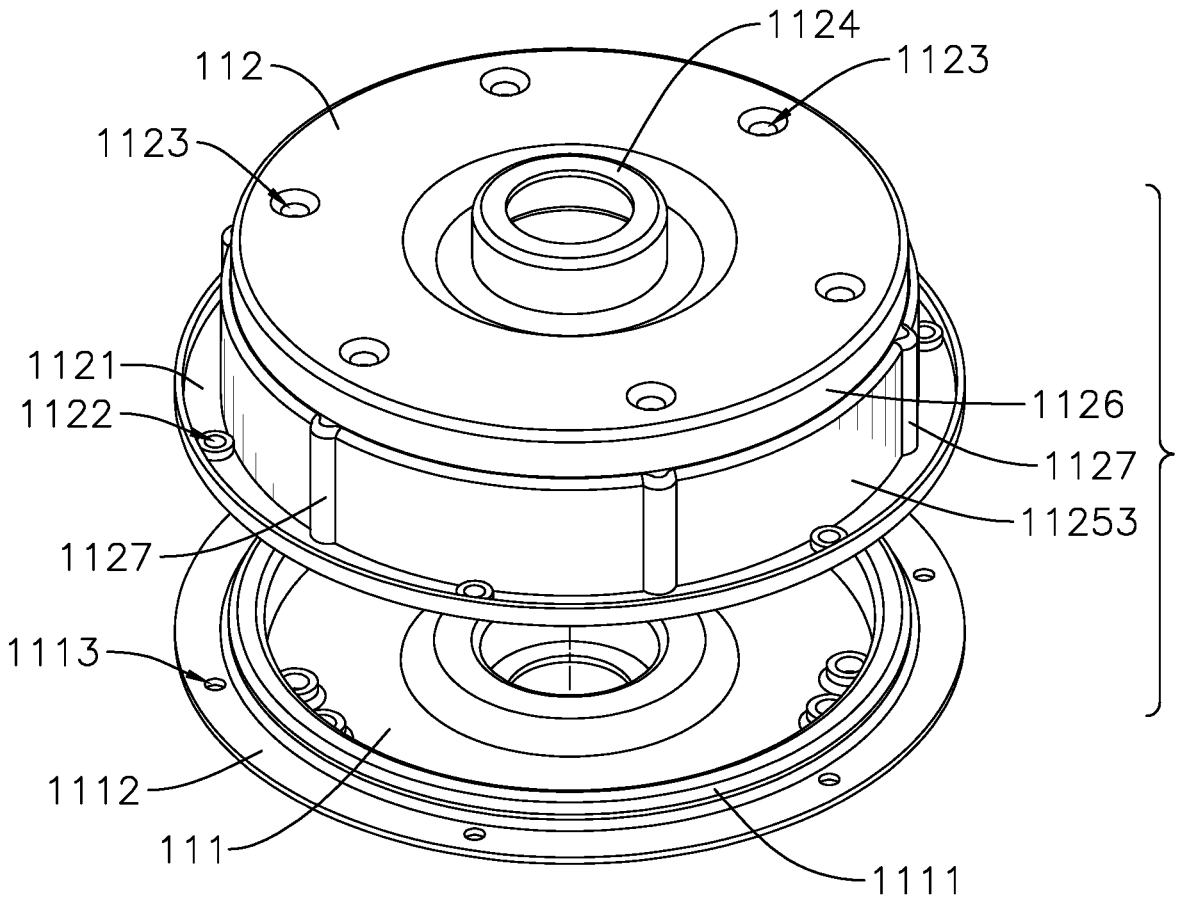
FIG. 7 is a perspective view of the first embodiment of the fan light in FIG. 1, showing the motor case.

In a preferred embodiment, with reference to FIGS. 3 and 7, the motor case 11 has an upper case 112 and a lower case 111. A positioning step 1111 is formed on a lower outer wall of the lower case 111. The positioning step 1111 protrudes upward. A lower flange 1112 is mounted on an edge of the positioning step, said edge being away from the lower outer wall of the lower case 111. The lower flange 1112 forms a lower assembling hole 1113. An upper flange 1121 is mounted on a bottom of an upper outer wall of the upper case 112. The upper flange 1121 forms an upper assembling hole 1122. When the lower case 111 is mounted on a bottom of the upper case 112, the positioning step 1111 engages with an inner surface of the upper case 112, and the lower assembling hole 1113 is aligned to the upper assembling hole 1122.

When assembling, engage the positioning step 1111 with the inner surface of the upper case 112 first. In the motor case 11, by the positioning step 1111 engaging with the inner surface of the upper case 112 to pre-position the lower case 111 and the upper case 112, the lower case 111 can be quickly aligned to the upper case 112, and the upper case 112 and the lower case 111 can be prevented from moving relative to each other even if the operator is not holding them. After the positioning step 1111 engages with the inner surface of the upper case 112, attach the upper flange 1121 to the lower flange 1112. Next, rotate the lower case 111 to align the lower assembling hole 1113 and the upper assembling hole 1122. Finally, mount a screw in the lower assembling hole 1113 and the upper assembling hole 1122 to fix the lower case 111 and the upper case 112. This embodiment solves the problem that the assembling efficiency is low and the motor case 11 cannot be assembled fast because the upper case 112 and the lower case 111 need to be held by hands to prevent from moving relative to each other after the upper case 112 and the lower case 111 are aligned. Additionally, the configuration of the positioning step 1111 enhances the structural strength of the motor case 11, and the configuration of the positioning step 1111 matching the upper case 112 enhances the roundness accuracy of the upper case 112.

Figure 9:
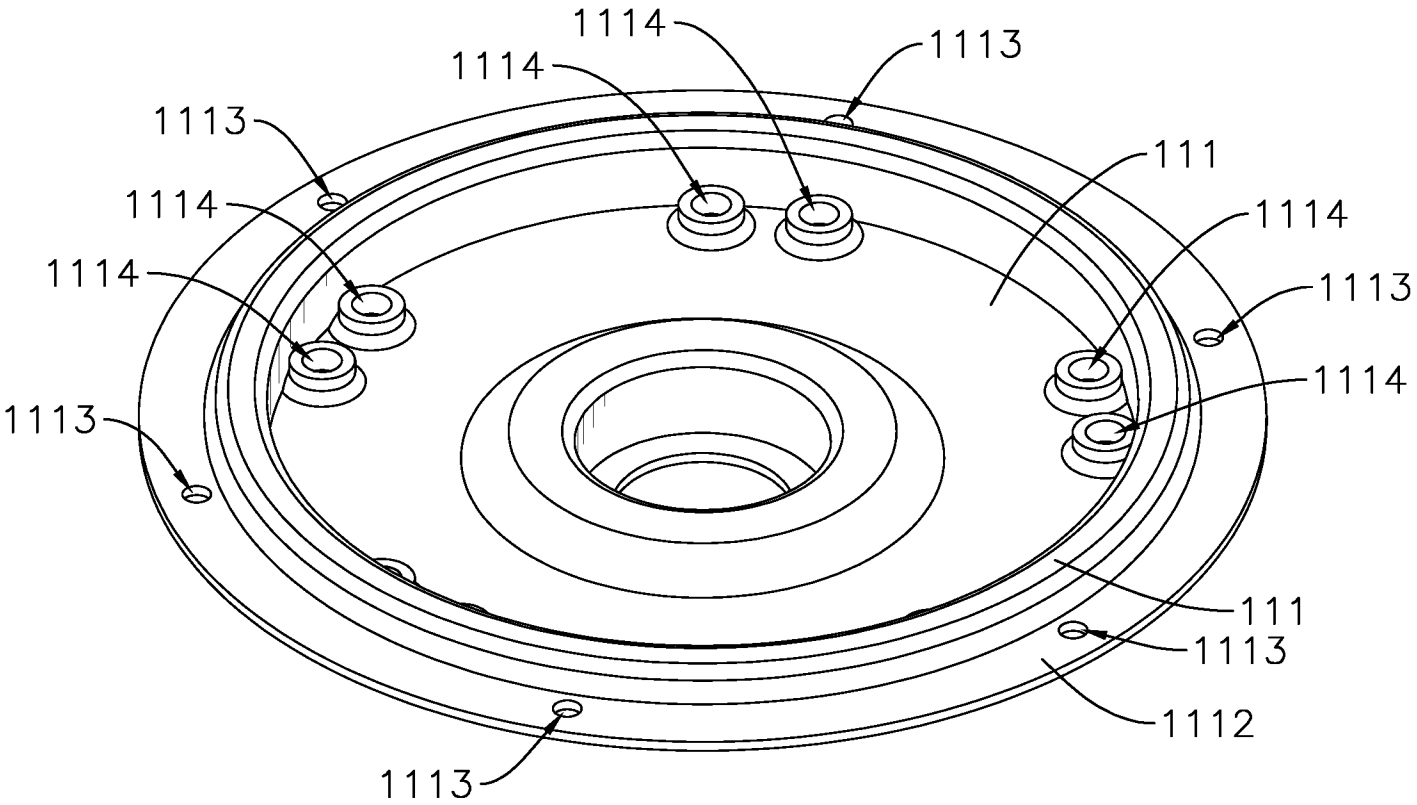
FIG. 9 is another perspective view of the first embodiment of the fan light in FIG. 1, showing the lower case.

With reference to FIGS. 7 and 9, in this embodiment, a bottom surface of the lower case 111 forms multiple lower fan blade mounting holes 1114, and a top surface of the upper case 112 forms multiple upper fan blade mounting holes 1123. The lower case 111 is a cast aluminum case or an injection molded case. The fan blades 13 are mounted on the top surface of the upper case 112 via the upper fan blade mounting holes 1123.

But in other embodiments, the lower case 111 can also be a metal stamping case. In this case, the positioning step 1111 is formed by bending two times, and the fan blades 13 are mounted on the top surface of the upper case 112 via the upper fan blade mounting holes 1123. Additionally, the fan blades 13 can also be mounted on the bottom surface of the lower case 111 via the lower fan blade mounting holes 1114.

Figure 10:
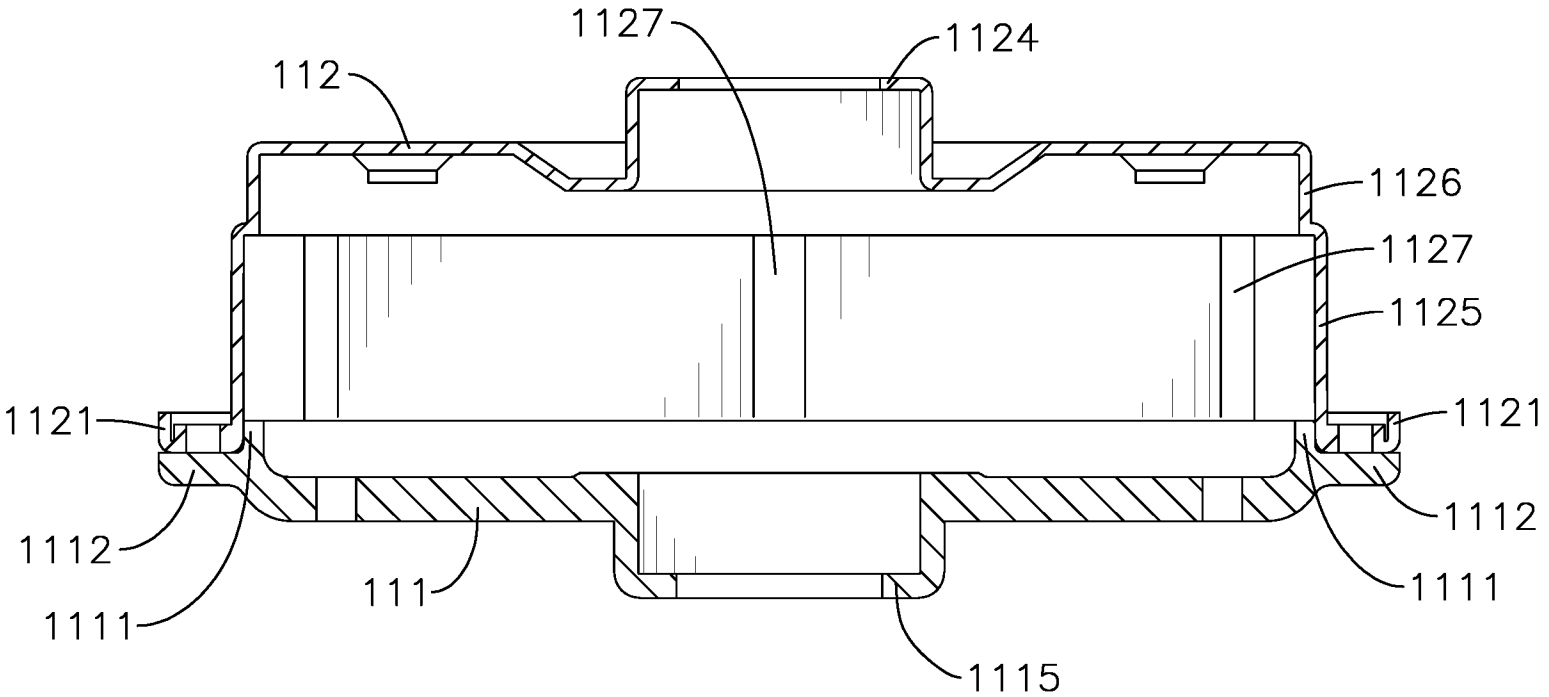
FIG. 10 is a side view in cross section of a second embodiment of a fan light in accordance with the present invention, showing the motor case.
Figure 11:
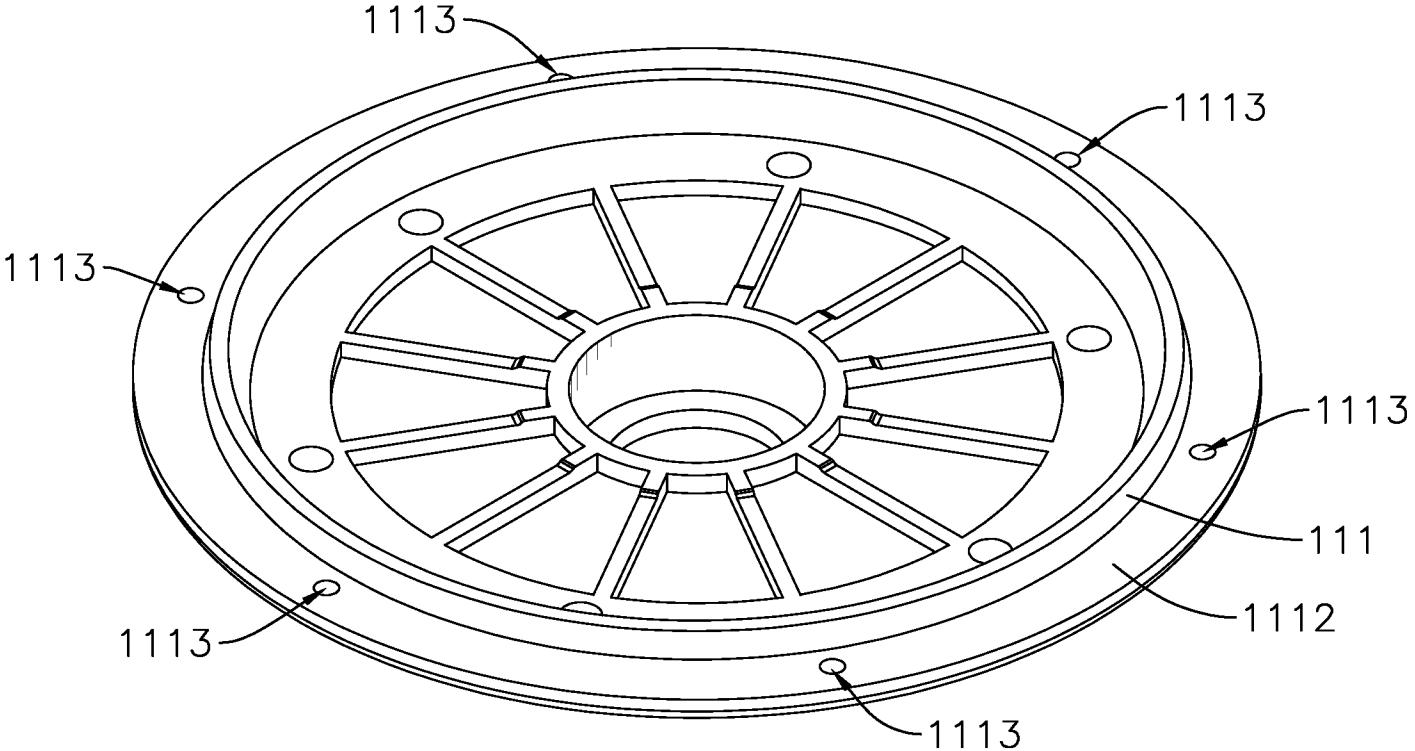
FIG. 11 is a perspective view of the second embodiment of the fan light in FIG. 10, showing the lower case.

With reference to FIGS. 10 and 11, since the fan blades 13 are mounted on the top surface of the upper case 112 via the upper fan blade mounting holes 1123, the loading on the lower case 111 is low so the lower case 111 can be implemented as a cast aluminum case or an injection molded case to reduce manufacturing cost. Moreover, the upper case 112 can be assembled with the lower case 111 made of different materials, providing a wide scope of application.

Figure 8:
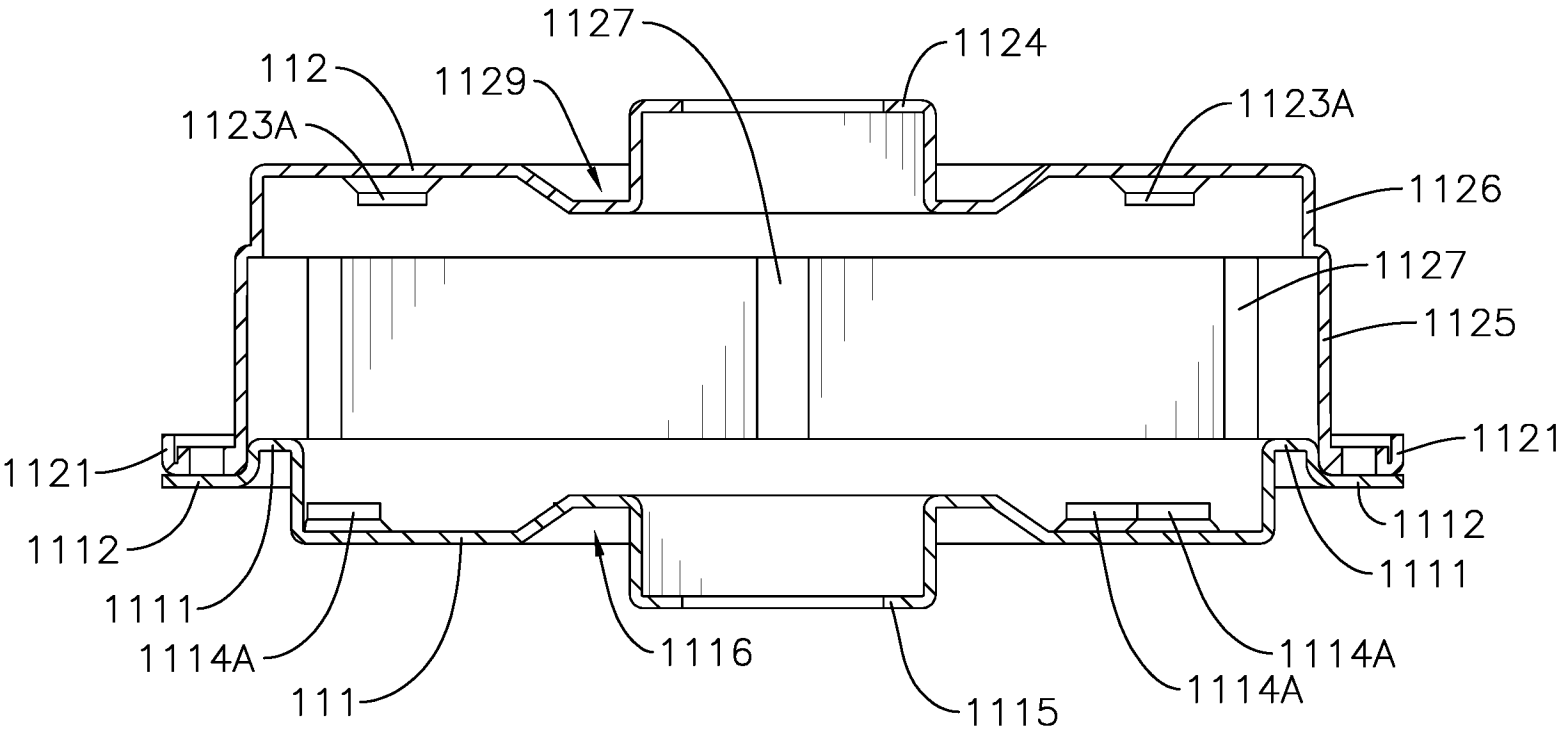
FIG. 8 is another side view in cross section of the first embodiment of the fan light in FIG. 1, showing the motor case.

With reference to FIGS. 8 and 9, the lower case 111 is stamped and bent twice to form the positioning step 1111. Compared to cast aluminum or injection molding processes, metal stamping shells use less material so the manufacturing cost is lower.

In a preferred embodiment, the fan blades 13 are mounted on the top surface of the upper case 112 via the upper fan blade mounting holes 1123. Since the upper case 112 bears all the fan blades 13, the torque can be directly transferred and the tolerances during assembling can be reduced to achieve high accuracy in assembling, so the fan light has less loss and a more stable performance. Further, the load on the lower case 111 can also be reduced and thus the lower case 111 will not easily detach from the upper case 112. In addition, different amounts of the fan blades 13 can be adapted by using the upper fan blade mounting holes 1123 or the lower fan blade mounting holes 1114.

Selectively, with reference to FIGS. 3, 7, 8, and 10, an annular wall of the upper case 112 has a magnetic tile mounting segment 1125 and a positioning step segment 1126. An inner surface of the magnetic tile mounting segment 1125 is adapted to mount a magnetic tile 113. The magnetic tile mounting segment 1125 and the positioning step segment 1126 are both ring structures. A fourth center axis of the magnetic tile mounting segment 1125 coincides with a fifth center axis of the positioning step segment 1126. A top end of the magnetic tile mounting segment 1125 is connected to a bottom end of the positioning step segment 1126. A diameter of the magnetic tile mounting segment 1125 is larger than a diameter of the positioning step segment 1126. The magnetic tile mounting segment 1125 has a positioning protrusion 1127. A lengthwise direction of the positioning protrusion 1127 is parallel to the fourth center axis of the magnetic tile mounting segment 1125. The positioning protrusion 1127 protrudes from the inner surface of the magnetic tile mounting segment 1125 radially inward.

After the magnetic tile 113 is mounted on the magnetic tile mounting segment 1125, the magnetic tile 113 and the upper case 112 are assembled as a rotor, and rotate around the main shaft 12 mounted through the motor case 11. Since the diameter of the magnetic tile mounting segment 1125 is larger than the diameter of the positioning step segment 1126, the positioning step segment 1126 is concaved inward relative to the magnetic tile mounting segment 1125 toward the fourth center axis of the magnetic tile mounting segment 1125, thereby forming a width difference in the horizontal direction. After the magnetic tile 113 is mounted on the magnetic tile mounting segment 1125, the width difference formed by the positioning step segment 1126 and the magnetic tile mounting segment 1125 stops the magnetic tile 113 from moving upward. Additionally, after the positioning step 1111 engages with the inner surface of the upper case 112, the positioning step 1111 stops the magnetic tile 113 from moving downward. The positioning protrusion 1127, the positioning step segment 1126 and the positioning step 1111 divide the inner wall of the magnetic tile mounting segment 1125 into a plurality of mounting compartments. After the magnetic tile 113 is mounted on the magnetic tile mounting segment 1125, the mounting compartment stops the magnetic tile 113 from moving in any direction, thereby preventing the magnetic tile 113 from moving and falling off during rotation of the motor case 11.

With reference to FIGS. 8 and 9, each of the lower fan blade mounting holes 1114 forms a first hole wall 1114A by casting, and the first hole wall 1114A protrudes upward from an inner bottom surface of the lower case 111, and each of the upper fan blade mounting holes 1123 forms a second hole wall 1123A by casting, and the second hole wall 1123A protrudes downward from an inner top surface of the upper case 112.

The configuration of the first hole wall 1114A enhances the structural strength of the lower fan blade mounting holes 1114, and the configuration of the second hole wall 1123A enhances the structural strength of the upper fan blade mounting holes 1123, so the lower fan blade mounting hole 1114 and the upper fan blade mounting hole 1123 will not be easily broken during rotating after assembled with the fan blades 13. Since the first hole wall 1114A protrudes upward from an inner bottom surface of the lower case 111, after the fan blades 13 are mounted on the bottom surface of the lower case 111, the fan blades 13 can be tightly attached to the bottom surface of the lower case 111, thereby improving structural stability. Since the second hole wall 1123A protrudes downward from an inner top surface of the upper case 112, after the fan blades 13 are mounted on the top surface of the upper case 112, the fan blades 13 can be tightly attached to the top surface of the upper case 112, thereby improving structural stability.

With reference to FIGS. 8 and 10, a lower flange 1112 is mounted on an edge of the positioning step 1111, said edge being away from the lower outer wall of the lower case 111. The lower flange 1112 is higher than the bottom surface of the lower case 111 in a vertical direction. In a preferred embodiment, the fan blade 13 is mounted on the bottom surface of the lower case 111 via the lower fan blade mounting hole 1114. Since the lower flange 1112 is higher than the bottom surface of the lower case 111 in the vertical direction, after a screw is mounted in the lower assembling hole 1113 of the lower flange 1112, the screw will not affect the fan blades 13 mounted on the bottom surface of the lower case 111.

A center of the bottom surface of the lower case 111 forms a lower protrusion 1115 protruding downward, and a lower main shaft hole is formed on a center of the lower protrusion 1115. A center of the top surface of the upper case 112 forms an upper protrusion 1124 protruding upward, and an upper main shaft hole is formed on a center of the upper protrusion 1124. The main shaft 12 is mounted through the lower main shaft hole and the upper main shaft hole. The configuration of the lower protrusion 1115 and the upper protrusion 1124 allows the upper case 112 and the lower case 111 to have adequate distances from other components after assembled with the motor case 11 as a ceiling fan, thereby preventing the other components from affecting the rotation of the fan blades 13.

The bottom surface of the lower case 111 integrally forms a lower annular groove 1116 surrounding an outer surface of the lower protrusion 1115. The top surface of the upper case 112 integrally forms an upper annular groove 1129 surrounding an outer surface of the upper protrusion 1124. With reference to FIG. 8, after assembled with the motor case 11 as a ceiling fan, the lower annular groove 1116 and the upper annular groove 1129 act as a buffer. Therefore, during rotation of the motor case 11 around the main shaft 12 of the motor, the lower protrusion 1115 and the lower case 111 would not be easily damaged at their point of connection, and also the upper protrusion 1124 and the upper case 112 would not be easily damaged at their point of connection.

Figure 5:
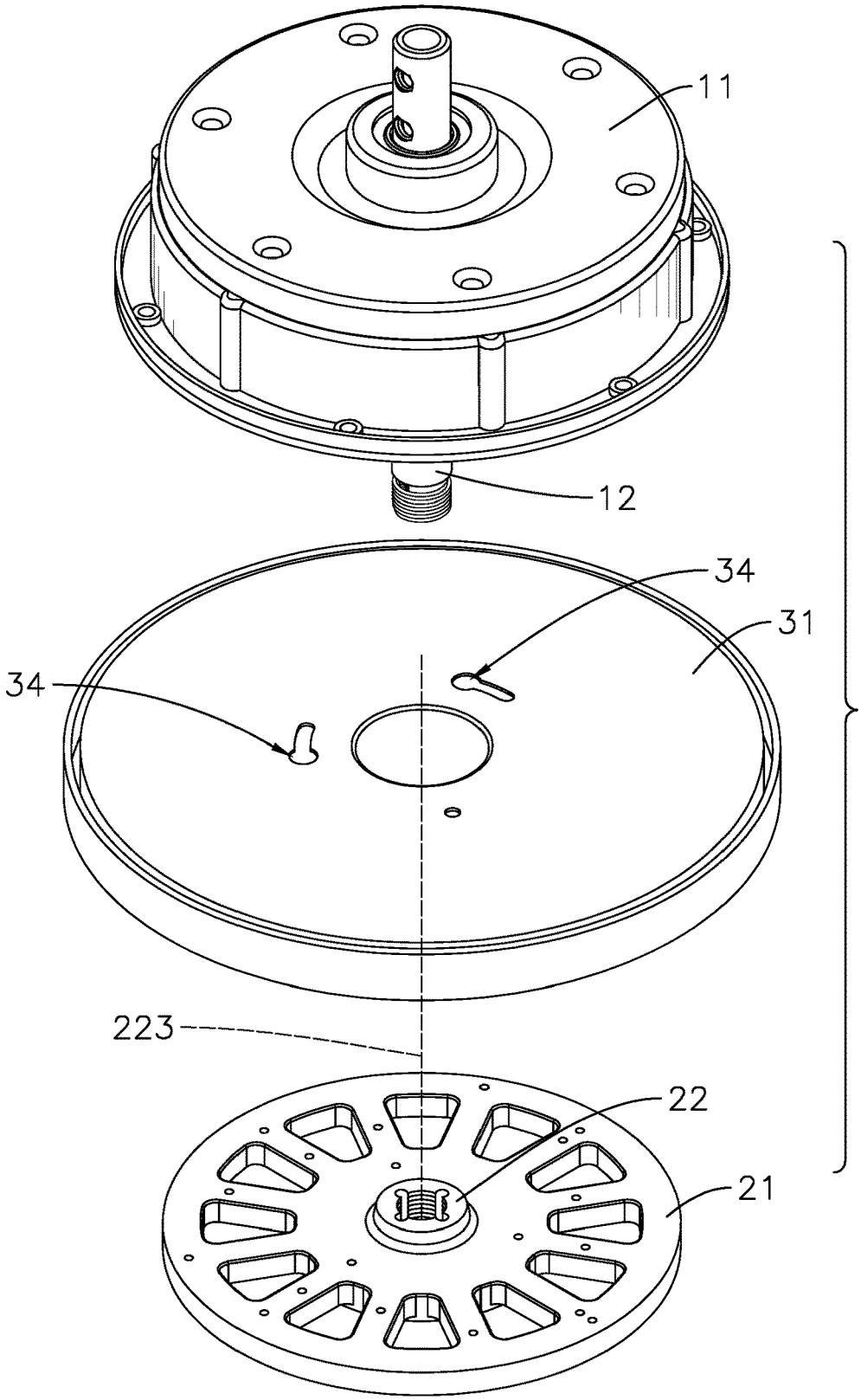
FIG. 5 is another exploded view of the first embodiment of the fan light in FIG. 1.

With reference to FIGS. 3 and 5, the inner surface of the main shaft connecting screw hole 22 forms a first thread, and a bottom end of the main shaft 12 forms a second thread. The first thread and the second thread engage with each other. The first center axis 223 of the main shaft connecting screw hole 22 is parallel to a third center axis of the connecting unit main body 21. Since the main shaft connecting screw hole 22 having the first thread is directly formed on the connecting unit main body 21, the main shaft 12 can be fixed in the main shaft connecting screw hole 22 via the second thread thereon to fix the main shaft 12 and the connecting unit main body 21. As there is no nut needed, there is no problem of nut loosening. Since the first center axis 223 of the main shaft connecting screw hole 22 is parallel to the third center axis of the connecting unit main body 21, after the main shaft 12 is fixed in the main shaft connecting screw hole 22, the main shaft 12 is perpendicular to the connecting assembly 2, thereby increasing the mounting stability of the connecting assembly 2.

Figure 4:
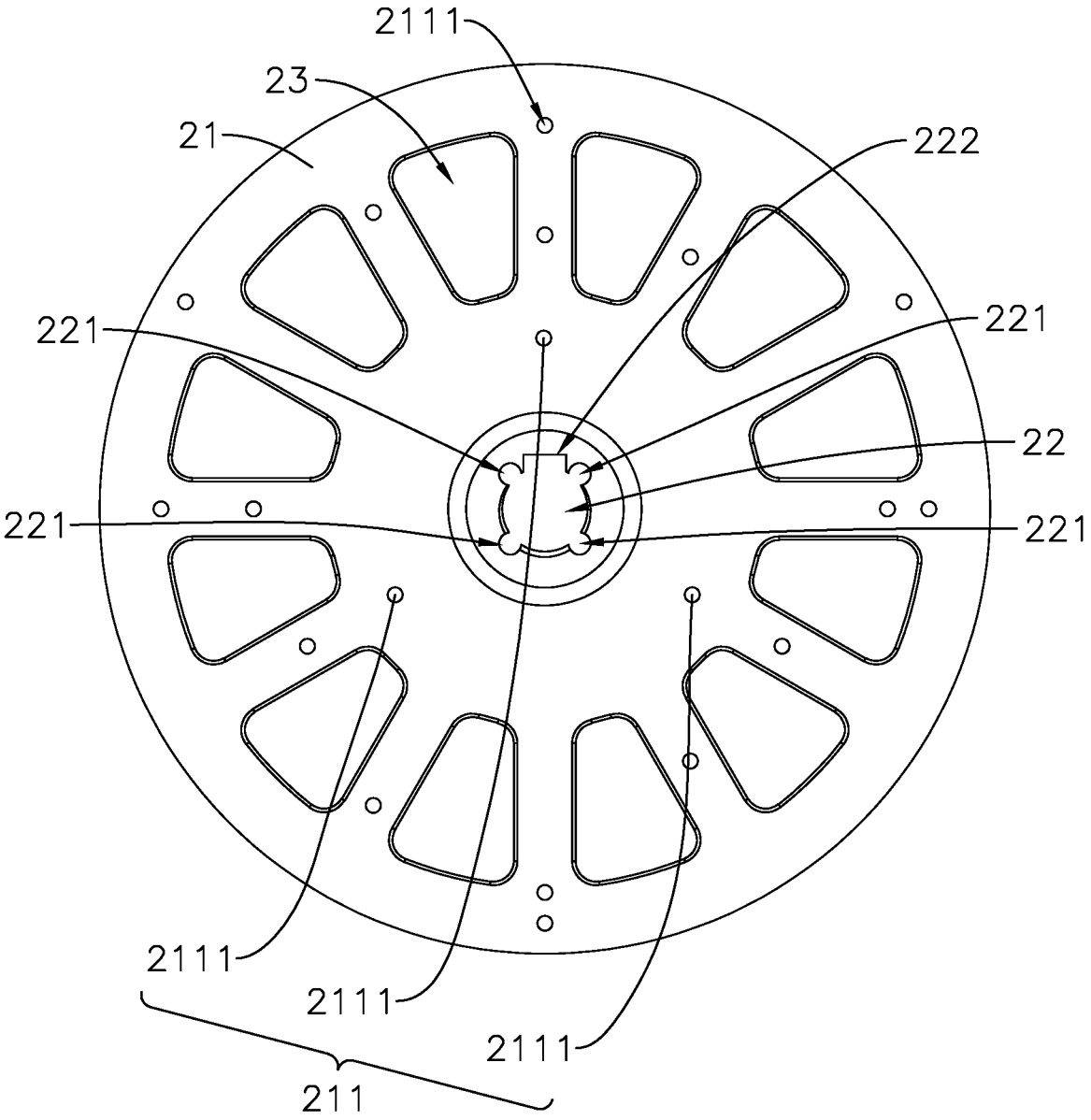
FIG. 4 is a top view of the first embodiment of the fan light in FIG. 1, showing the connecting assembly.

In a preferred embodiment, with reference to FIG. 4, the top surface of the connecting unit main body 21 forms a plurality of said lighting disc hole groups 211. The lighting disc hole groups 211 are arranged along a radial direction of the connecting unit main body 21. The lighting disc fixing holes 2111 in each of the lighting disc hole groups 21 are arranged along a circumferential direction of a circle formed around a center of the connecting unit main body 21 and are equidistantly spaced apart. Different lighting disc hole groups 211 can be selected for installation according to arrangements of installation holes of different light discs, so that different lighting disc assemblies 3 can be adapted, and therefore the application range of the connecting assembly 2 is wider. Specifically, diameters of the lighting disc fixing holes 2111 of each of the lighting disc hole groups 211 are different, so that the lighting disc assemblies 3 of various materials and specifications can be adapted. Since the lighting disc fixing holes 2111 are arranged along the circumferential direction of the circle formed around the center of the connecting unit main body 21 and are spaced equidistantly apart, after the lighting disc assembly 3 is fixed on the top surface of the connecting unit main body 21 with a screw, the force generated between the connecting unit main body 21 and the lighting disc assembly 3 is balanced, so that the installation stability of the lighting disc assembly 3 can be improved, and therefore the lighting disc assembly 3 is not easily loosened.

Selectively, with reference to FIG. 6, a section of the screw fixing hole 221 forms a major circular segment, and the main shaft 12 has a fixing groove 121 matching the screw fixing hole 221 and forming a fixing screw hole 4 with the screw fixing hole 221. A major circular segment is a portion of a circle that is larger than a semicircle. Since the section of the screw fixing hole 221 forms a major circular segment, after a screw is mounted in the screw fixing hole 221, the main force will be concentrated on the connecting unit main body 21, so as to ensure that the main shaft 12 is not easily damaged. Since the main shaft 12 has the fixing groove 121 matching the screw fixing hole 221 that has the section formed as the major circular segment and forming the complete fixing screw hole 4 with the screw fixing hole 221, when assembling, the operator only needs to align the screw fixing hole 221 with the fixing groove 121 of the main shaft 12 and tighten a screw into the fixing screw hole 4, and then the main shaft 12 and the connecting assembly 2 can be further fixed.

With reference to FIG. 4, the inner surface of the main shaft connecting screw hole 22 forms a cable groove 222. The cable groove 222 extends along the first center axis 223 of the main shaft connecting screw hole 22. With the cable groove 222, a power wire can pass through the cable groove 222 from top to bottom and be electrically connected to the lighting unit main body 32, so as to prevent the power wire from exposure and ensure safety of the power wire. Additionally, during installation, the operator does not need to open additional holes to mount the power wire, which improves the installation efficiency.

Preferably, with reference to FIG. 4, the connecting unit main body 21 forms multiple heat dissipating through holes 23 arranged along the circle formed around the center of the connecting unit main body 21 and are spaced equidistantly apart. When the lighting disc assembly 3 is operating, the lighting unit main body 32 glows and generates heat. Thus, the heat dissipating through hole 23 is provided to dissipate the heat in the light cover 33 of the lighting disc assembly 3 to an exterior, so as to prevent the temperature inside the light cover 33 from being too high and shortening the service life of the bodies 32. The connecting unit main body 21 is a plastic molding structure and has an insulation layer, which prevents short circuit.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A fan light comprising:

a fan assembly having a motor case;

a main shaft mounted through the motor case; and multiple fan blades mounted on the motor case; the motor case driving the multiple fan blades to rotate around the main shaft;

a connecting assembly having a connecting unit main body; and a main shaft connecting screw hole formed through the connecting unit main body; the main shaft mounted in the main shaft connecting screw hole; the main shaft connecting screw hole having a first center axis;

a screw fixing hole formed on an inner surface of the main shaft connecting screw hole and formed through a bottom surface of the connecting unit main body; the screw fixing hole having a second center axis being parallel to the first center axis of the main shaft connecting screw hole;

a fixing unit mounted in the screw fixing hole to fix the main shaft and the main shaft connecting screw hole; and at least one lighting disc hole group formed on a top surface of the connecting unit main body; each of the at least one lighting disc hole group having multiple lighting disc fixing holes;

a lighting disc assembly having a lighting disc fixing shell;

multiple lighting disc mounting holes formed on the lighting disc fixing shell; a distance between each of the multiple lighting disc mounting holes and the first center axis of the main shaft connecting screw hole being shorter than a radius of the connecting unit main body; the lighting disc fixing shell fixed on the top surface of the connecting unit main body via the multiple lighting disc mounting holes and the multiple lighting disc fixing holes.

2. The fan light as claimed in claim 1, wherein the motor case has a lower case having a lower outer wall;

a positioning step formed on the lower outer wall and protruding upward;

a lower flange mounted on an edge of the positioning step, said edge being away from the lower outer wall; and a lower assembling hole formed on the lower flange; and an upper case having an upper outer wall;

an upper flange mounted on a bottom of the upper outer wall; and an upper assembling hole formed on the upper flange;

wherein when the lower case is mounted below the upper case, the positioning step abuts an upper inner wall of the upper case and the lower assembling hole is aligned to the upper assembling hole.

3. The fan light as claimed in claim 2, wherein the lower case is a metal stamping case;

the positioning step is formed by bending two times;

multiple lower fan blade mounting holes are formed on a bottom surface of the lower case; and the multiple fan blades are mounted on the bottom surface of the lower case via the multiple lower fan blade mounting holes.

4. The fan light as claimed in claim 3, wherein each of the multiple lower fan blade mounting holes forms a first hole wall via casting, and the first hole wall protrudes upward from an inner bottom surface of the lower case.

5. The fan light as claimed in claim 2, wherein the lower case is a cast aluminum case or an injection molded case;

multiple upper fan blade mounting holes are formed on a top surface of the upper case; and the multiple fan blades are mounted on the top surface of the upper case via the multiple upper fan blade mounting holes.

6. The fan light as claimed in claim 5, wherein each of the multiple upper fan blade mounting holes forms a second hole wall via casting, and the second hole wall protrudes downward from an inner top surface of the upper case.

7. The fan light as claimed in claim 6, wherein an annular wall of the upper case has a magnetic tile mounting segment being a ring structure; an inner surface of the magnetic tile mounting segment adapted for mounting a magnetic tile; the magnetic tile mounting segment having a positioning protrusion protruding from the inner surface of the magnetic tile mounting segment radially inward; a lengthwise direction of the positioning protrusion being parallel to an axis of the magnetic tile mounting segment; and a positioning step segment being a ring structure; an axis of the positioning step segment coinciding with the axis of the magnetic tile mounting segment; a top end of the magnetic tile mounting segment connected to a bottom end of the positioning step segment; a diameter of the magnetic tile mounting segment being larger than a diameter of the positioning step segment.

8. The fan light as claimed in claim 7, wherein a first thread is formed on the inner surface of the main shaft connecting screw hole;

a second thread is formed on a bottom end of the main shaft and engages with the first thread; and a third axis of the connecting unit main body is parallel to the first center axis of the main shaft connecting screw hole.

9. The fan light as claimed in claim 8, wherein the top surface of the connecting unit main body forms a plurality of said lighting disc hole groups;

the lighting disc hole groups are arranged along a radial direction of the connecting unit main body; and the multiple lighting disc fixing holes in each of the lighting disc hole groups are arranged along a circumferential direction of a circle formed around a center of the connecting unit main body and are spaced equidistantly apart.

10. The fan light as claimed in claim 9, wherein the connecting unit main body has multiple heat dissipating through holes arranged along the circumferential direction of the circle and spaced equidistantly apart.

11. The fan light as claimed in claim 10, wherein a section of the screw fixing hole forms a major circular segment;

the main shaft has a fixing groove matching the screw fixing hole that has the section formed as the major circular segment, wherein the fixing groove and the screw fixing hole form a fixing screw hole.

12. The fan light as claimed in claim 11, wherein a cable groove is formed on the inner surface of the main shaft connecting screw hole and extends along the first center axis of the main shaft connecting screw hole.

13. The fan light as claimed in claim 2, wherein an annular wall of the upper case has a magnetic tile mounting segment being a ring structure; an inner surface of the magnetic tile mounting segment adapted for mounting a magnetic tile; the magnetic tile mounting segment having a positioning protrusion protruding from the inner surface of the magnetic tile mounting segment radially inward; a lengthwise direction of the positioning protrusion being parallel to an axis of the magnetic tile mounting segment; and a positioning step segment being a ring structure; an axis of the positioning step segment coinciding with the axis of the magnetic tile mounting segment; a top end of the magnetic tile mounting segment connected to a bottom end of the positioning step segment; a diameter of the magnetic tile mounting segment being larger than a diameter of the positioning step segment.

14. The fan light as claimed in claim 1, wherein a first thread is formed on the inner surface of the main shaft connecting screw hole;

a second thread is formed on a bottom end of the main shaft and engages with the first thread; and a third axis of the connecting unit main body is parallel to the first center axis of the main shaft connecting screw hole.

15. The fan light as claimed in claim 1, wherein the top surface of the connecting unit main body forms a plurality of said lighting disc hole groups;

the lighting disc hole groups are arranged along a radial direction of the connecting unit main body; and the multiple lighting disc fixing holes in each of the lighting disc hole groups are arranged along a circumferential direction of a circle formed around a center of the connecting unit main body and are spaced equidistantly apart.

16. The fan light as claimed in claim 15, wherein the connecting unit main body has multiple heat dissipating through holes arranged along the circumferential direction of the circle and spaced equidistantly apart.

17. The fan light as claimed in claim 1, wherein a section of the screw fixing hole forms a major circular segment;

the main shaft has a fixing groove matching the screw fixing hole that has the section formed as the major circular segment, wherein the fixing groove and the screw fixing hole form a fixing screw hole.

18. The fan light as claimed in claim 1, wherein a cable groove is formed on the inner surface of the main shaft connecting screw hole and extends along the first center axis of the main shaft connecting screw hole.

* * * * *